US007654578B2

(12) United States Patent
Reinhart

(10) Patent No.: US 7,654,578 B2
(45) Date of Patent: Feb. 2, 2010

(54) SECURITY DOCUMENT COMPRISING AT LEAST ONE SECURITY ELEMENT

(75) Inventor: Werner Reinhart, Zirndorf (DE)

(73) Assignee: Leonhard Kurz Stiftung & Co. KG, Furth (DE)

( * ) Notice: Subject to any disclaimer, the term of this patent is extended or adjusted under 35 U.S.C. 154(b) by 511 days.

(21) Appl. No.: 10/541,935

(22) PCT Filed: Jan. 20, 2004

(86) PCT No.: PCT/DE2004/000007

§ 371 (c)(1),
(2), (4) Date: Jul. 8, 2005

(87) PCT Pub. No.: WO2004/069560

PCT Pub. Date: Aug. 19, 2004

(65) Prior Publication Data

US 2006/0119096 A1 Jun. 8, 2006

(30) Foreign Application Priority Data

Feb. 10, 2003 (DE) ..... 103 05 288

(51) Int. Cl.
*B42D 15/10* (2006.01)
*B44C 3/02* (2006.01)

(52) U.S. Cl. ..... 283/72; 428/67; 162/140

(58) Field of Classification Search ..... 283/72, 283/74, 93, 94, 98, 101, 105; 162/117, 134, 162/140; 428/67, 915, 916
See application file for complete search history.

(56) References Cited

U.S. PATENT DOCUMENTS

| | | | | |
|---|---|---|---|---|
| 4,420,515 | A * | 12/1983 | Amon et al. | 428/29 |
| 4,534,398 | A * | 8/1985 | Crane | 162/103 |
| 5,393,099 | A | 2/1995 | D'Amato | |
| 5,582,103 | A * | 12/1996 | Tanaka et al. | 101/32 |
| 5,961,152 | A * | 10/1999 | Washburn et al. | 283/72 |
| 6,042,260 | A | 3/2000 | Heidemeyer et al. | |
| 6,176,522 | B1 | 1/2001 | Jackson | |

(Continued)

FOREIGN PATENT DOCUMENTS

AU B-77389/94 5/1995

(Continued)

OTHER PUBLICATIONS

Wolkomir, Richard, "Charting the Terrain of Touch", *Smithsonian magazine*, vol. 31, issue 3, pp. 38-48 (2000).

(Continued)

*Primary Examiner*—Dana Ross
*Assistant Examiner*—Pradeep C Battula
(74) *Attorney, Agent, or Firm*—Hoffmann & Baron, LLP

(57) ABSTRACT

There is proposed a security document comprising a security element, wherein the security element is of such a configuration that it can be determined by means of the sense of human touch. For that purpose either the surface nature of various surface regions can be selected differently so that the configuration and size of the different surface regions can be determined by the human sense of touch. Another possibility is for the substrate of the security document to be provided with suitably shaped openings which can be identified by means of the human sense of touch. A combination of different tactile security elements of that kind is also described.

19 Claims, 2 Drawing Sheets

U.S. PATENT DOCUMENTS

| | | | | |
|---|---|---|---|---|
| 6,227,572 | B1 * | 5/2001 | Lyen | 283/58 |
| 6,428,051 | B1 | 8/2002 | Herrmann et al. | |
| 6,508,489 | B2 * | 1/2003 | Herrmann et al. | 283/57 |
| 6,808,792 | B1 | 10/2004 | Weber | |
| 6,817,689 | B1 * | 11/2004 | Annacone | 347/2 |
| 7,331,043 | B2 * | 2/2008 | Saulsbury | 717/143 |
| 2002/0030360 | A1 * | 3/2002 | Herrmann et al. | 283/72 |
| 2003/0145747 | A1 | 8/2003 | Mayer et al. | |
| 2003/0151246 | A1 | 8/2003 | Baldus et al. | |
| 2004/0050269 | A1 | 3/2004 | Adamczyk et al. | |
| 2005/0012326 | A1 * | 1/2005 | Keller et al. | 283/94 |
| 2005/0151368 | A1 * | 7/2005 | Heim | 283/72 |
| 2006/0145468 | A1 * | 7/2006 | Plaschka et al. | 283/72 |

FOREIGN PATENT DOCUMENTS

| | | | |
|---|---|---|---|
| CA | 2 404 853 | A1 | 9/2002 |
| DE | 946585 | | 8/1956 |
| DE | 1632482 | | 7/1970 |
| DE | 2417549 | | 11/1974 |
| DE | 4334847 | A1 | 4/1995 |
| DE | 4342964 | A1 | 6/1995 |
| DE | 19536461 | C1 | 11/1996 |
| DE | 19940790 | A1 | 3/2001 |
| DE | 19949881 | A1 | 4/2001 |
| DE | 19963849 | A1 | 7/2001 |
| DE | 10015097 | A1 | 10/2001 |
| DE | 10044464 | A1 | 3/2002 |
| DE | 10162050 | A1 | 7/2003 |
| EP | 1 122 089 | A2 | 8/2001 |
| EP | 1478520 | | 11/2004 |
| EP | 1525102 | | 4/2005 |
| GB | 1 249 900 | | 10/1971 |
| GB | 1 471 334 | | 4/1977 |
| JP | 2001039005 | | 2/2001 |
| WO | WO 01/72525 | A1 | 10/2001 |

OTHER PUBLICATIONS

Kay, Brian H. "Science and the Detective", *Selected Reading in Forensic Science*, p. 20 (1995).

* cited by examiner

SECURITY DOCUMENT COMPRISING AT LEAST ONE SECURITY ELEMENT

This application claims priority based on an International Application filed under the Patent Cooperation Treaty, PCT/DE2004/000007, filed on Jan. 20, 2004, and German Patent Application No. 10305288.7-45, filed on Feb. 10, 2003.

BACKGROUND OF THE INVENTION

The invention concerns security documents, in particular value-bearing papers, comprising at least one security element on a surface of the substrate forming the security document and/or at least one window-like opening in the substrate, forming at least part of a security element.

Value-bearing papers, in particular banknotes, check forms, share certificates and so forth are increasingly provided with security elements which make forgery more difficult and which are intended to permit a check on authenticity even for a lay person, without involving major difficulties. A corresponding consideration also applies in regard to other security documents, for example identity cards and passes, visas and so forth. In that respect, the security elements which are being used to an ever increasing extent are optically variable or optically effective identifications, for example structures having an optical-diffraction effect, for example holograms, partially reflective surface regions and so forth. It is further known to increase the level of security of value-bearing papers by special printing processes or also to use special substrates, whether paper or plastic material, for the production of corresponding value-bearing papers, in particular banknotes. In this connection the use of given printing processes or the use of special substrates already provides that the surface of the corresponding security document, in particular a banknote, acquires a quite specific roughness or structure which is perceptible to the human sense of touch. It will be noted however that the tactility which is achieved by virtue of the special printing process or the substrate material used is not of prolonged duration, particularly in the case of value-bearing papers which are frequently in use such as banknotes. More specifically the surface nature which arises by virtue of the special printing process or the material used is generally altered very quickly when using the banknotes or the like because perspiration, dirt or other foreign materials accumulate on the surface or the surface changes comparatively quickly as a consequence of mechanical loading and the effect of moisture.

It is already known from DE 43 34 847 to provide value-bearing documents with a window which is subsequently introduced into the substrate but which then in turn is closed with a film which is at least region-wise transparent. Such a window can admittedly be felt by means of the sense of touch. It is however not suitable for actually forming a reliable tactile security element unless there are additional specific safeguard measures in the region of the film closing the window or the usual substrate of the value-bearing paper so that it is not possible to at least make it difficult to copy such items, in a simple fashion.

Finally, it is also already known for banknotes to be provided with special structure features which can be sensed by blind persons or visually impaired persons in order to enable them to establish the value of the corresponding banknote. Those visual impairment guidance features however are also not suitable as general security elements because they can be correctly sensed and recognised by tactile means only by especially trained users. In addition circulation-related influences can cause a marked reduction in tactile perceptibility.

Further documents with security elements are known from the following publications:

DE 101 62 050 which was published after the relevant date describes a data carrier printed with a tactile half-tone image and a process for the production thereof.

DE 100 44 464 describes a data carrier having a security element which can be at least visually checked and which has an embossing on a partial region thereof.

DE 199 63 849 also claims a data carrier having a printing security element comprising a plurality of structure elements, wherein a part of the structure elements is relief-like and can be felt by touch.

DE 100 15 097 describes a data carrier which is printed upon using piercing intaglio printing.

DE 1 632 482 describes a forgery-proof identity card comprising a plastic material sheet with a writable coating. In an embodiment of the identity card the writable coating has grid-like openings which are of such a small diameter that the coating is writable.

DE 946 585 discloses a stick-on value stamp.

DE 2417549 describes a process for the production of patterns which make forgery more difficult, in value-bearing papers, wherein it is provided that a pattern is introduced into the value-bearing papers by abrading.

DE 43 42 964 describes a technical process for the production of banknotes which afford a safeguard against forgery by copying. That process provides producing an opening, for example a window, in the banknote. That opening is filled by a woven, braided, knotted or glued inlay of lattice material which is introduced into the center between the banknote layers, similarly to the known silver threads.

DE 195 36 461 discloses value-bearing printed transaction units, for example tickets or the like, with cut-out opening patterns.

SUMMARY OF THE INVENTION

Now, the object of the present invention is to provide a security document, in particular a value-bearing paper, having a security element which markedly differs from the hitherto usual security elements and which on the one hand can be easily produced or applied with a sufficient safeguard effect for the authorised producers but which on the other hand can also be verified without major difficulties from the point of view of an unpractised or untrained user.

In accordance with the invention, in a security document of the kind set forth in the opening part of this specification, to attain that object it is now proposed that to form a security element at least one surface region of the security document is of a configuration and size specific to the respective security document in such a way and is spatially displaced, for example recessed or raised, at least relative to the surface of the substrate which is adjacent or surrounding the surface region, and/or is of such a different roughness (in the sense of differing macroscopic and microscopic structure), hardness, elasticity, slipperiness, thermal conductivity and/or stickiness, that the configuration and size of the surface region can be established as a consequence of the differing surface nature thereof by means of the human sense of touch.

In accordance with the invention therefore it is proposed that a security document, in particular a value-bearing paper, is such that, using the human sense of touch, it can be checked to ascertain whether it has a given security element or not, that is to say whether it is actually genuine. In that respect, in accordance with the invention two features are combined, namely on the one hand the combination of surface regions of a different tactile nature on the overall surface of the security document and on the other hand a specific geometrical configuration in respect of at least one surface region involving a given tactility. Therefore, for checking authenticity, a user must establish both the configuration of the at least one surface region forming a security element and also on the other hand the differing surface nature, in which respect it is precisely the different surface nature within and outside the region of a specific configuration, that contributes to the fact that even less proficient or unskilled users, as a consequence of the perceptible differing structure, can detect the configuration of the region serving as the security element and in that way can check whether there is a very high degree of probability whether this is a genuine or rather a forged security document.

There are different possible ways of producing the at least one surface region of the security document involving the specific configuration.

On the one hand, it is provided in accordance with the invention that the at least one surface region comprises a different material from the substrate, in which respect advantageously the substrate and the at least one surface region are formed by different kinds of film which differ markedly in properties which can be detected by means of the human sense of touch. In that connection the expression 'kinds of film' is used to denote not only plastic films or comparable products but for example also webs of paper, webs of textile material and so forth. In that case the at least one surface region with the specific configuration is advantageously produced by a first film with the properties provided for the at least one surface region being applied to the film or web forming the substrate, for example by being laminated thereonto or embossed thereonto.

A further possible design configuration for the security document according to the invention provides that the substrate and the at least one surface region are formed by paper with markedly different surface properties which can be respectively detected by means of the human sense of touch. In that respect the differing surface properties of the paper can be formed on the one hand by suitable printing thereon, for example by using special printing processes which are known per se for the production of value-bearing papers or bonds. Another possible way is for the different surface properties of the paper to be produced by region-wise mechanical processing of the paper, in particular by roughening it, by embossing and/or glazing.

It is further provided in accordance with the invention that the at least one surface region is formed by a film portion which is of a suitable configuration and which is applied to the substrate. That procedure is distinguished on the one hand by a comparatively low level of apparatus expenditure. On the other hand the use of corresponding film portions affords very extensive possible options in regard to structuring of the corresponding surface, for which purpose for example the film portion can be suitably embossed or it can be designed from the outset to be of differing thickness, for example with a specific pattern.

It is particularly advantageous if in accordance with the invention the film portion has openings through which the surface of the substrate can be felt because then on the one hand the recognisability of the security element and on the other hand the forgery-proof nature thereof are improved.

In order further to enhance the degree of safeguard or to provide for improved protection from imitations, it may be appropriate if the security document has a plurality of suitably designed surface regions which involve differing surface properties in comparison with the substrate surface, wherein those surface regions should then appropriately involve a differing configuration, size and/or surface nature.

The subject-matter of the invention is also a security document, in particular a value-bearing paper or bond, in which a window-like opening in the substrate of the security document forms at least part of the security element. In the case of such a security document, it is proposed that the concept of the invention be carried into effect by the window-like opening being of a configuration and size which is specific to the respective security document and by the window-like opening being so designed that the configuration and size of the opening can be determined by means of the human sense of touch. In contrast to the known security documents with a window which is used for visual checking therethrough, it is thus proposed in accordance with the invention that the window is additionally to be provided in a quite specific configuration and size, whereby authenticity checking is facilitated and forgeries are made more difficult.

In order not to adversely affect the stability of the banknote or another security document by virtue of the presence of a corresponding window, it can be appropriate for the opening to be covered—in per se known manner—by means of a film which is fixed on the surface of the substrate, in which case that film can desirably involve a surface nature which is markedly different from the surface nature of the substrate in a manner which can be detected by means of the human sense of touch.

A further improvement in the security properties can be achieved, in the case of such a configuration of a security document, by the film projecting beyond the opening or openings in the substrate and being provided in its projecting region with at least one aperture through which the surface of the substrate can be felt, whereby virtually different security elements are combined.

Apart from the possibility which has already been mentioned above of structuring a film forming the region of specific size and configuration by embossing or the like, there is also the possibility of the film being provided at least region-wise with a coating producing a special, feelable surface nature, for example printing thereon.

A configuration for the security element which can be particularly well felt is achieved if the film is provided with a perforation at least in its region covering the opening, wherein that perforation can advantageously be in the form of a pattern which can be easily perceived by touch, for example an alphanumeric character or an easily remembered geometrical figure.

Similarly to the above-discussed security document with various regions involving a specific surface nature and configuration on the substrate, the security document can also have a plurality of window-like openings which can be felt in respect of configuration and size by means of the human sense of touch, wherein the openings are desirably of different configuration and/or size and/or can be covered with a film involving different properties.

In order to facilitate recognition of the security feature, it is desirable if the edge of the at least one surface region is of the configuration of a simple geometrical figure, in which respect the configuration involved may naturally not be so simple that it does not have any distinguishing features.

In that connection it is particularly appropriate from the practical point of view if the at least one surface region is in the form of an elongate rectangle, in particular of a strip form.

It is further provided that at least in the one surface region the substrate is deformed by embossing to produce forwardly curved portions on one surface of the substrate and corresponding recesses on the other surface of the substrate, thereby also producing a security document configuration which is special in a region-wise manner and which can be detected by means of the human sense of touch.

It will be appreciated that the above-discussed security measures can also be combined with each other in such a way that the substrate has at least one surface region with a surface nature which differs in relation to the surrounding surface of the substrate, and at least one opening.

In addition however it is also possible to provide a combination with other security elements, in which respect it is generally advantageous if the security document is provided with at least one further security element which can be checked optically and/or by machine.

In this connection it may be advantageous if the security element which can be checked optically and/or by machine overlaps in at least region-wise manner with the at least one surface region of a surface nature which differs from the surrounding surface of the substrate and/or the opening, because such an overlap of various security element generally causes quite major difficulties in forging a security document.

Finally, it is in accordance with the invention for the security element which can be checked optically and/or by machine to be formed by a pattern consisting of diffractive structures, for example a hologram, and/or region-wise metallisation.

BRIEF DESCRIPTION OF THE DRAWINGS

Further features, details and advantages of the invention will be apparent from the description hereinafter of two embodiments by way of example with reference to the drawing in which.

DESCRIPTION OF THE PREFERRED EMBODIMENTS

Figure 1:
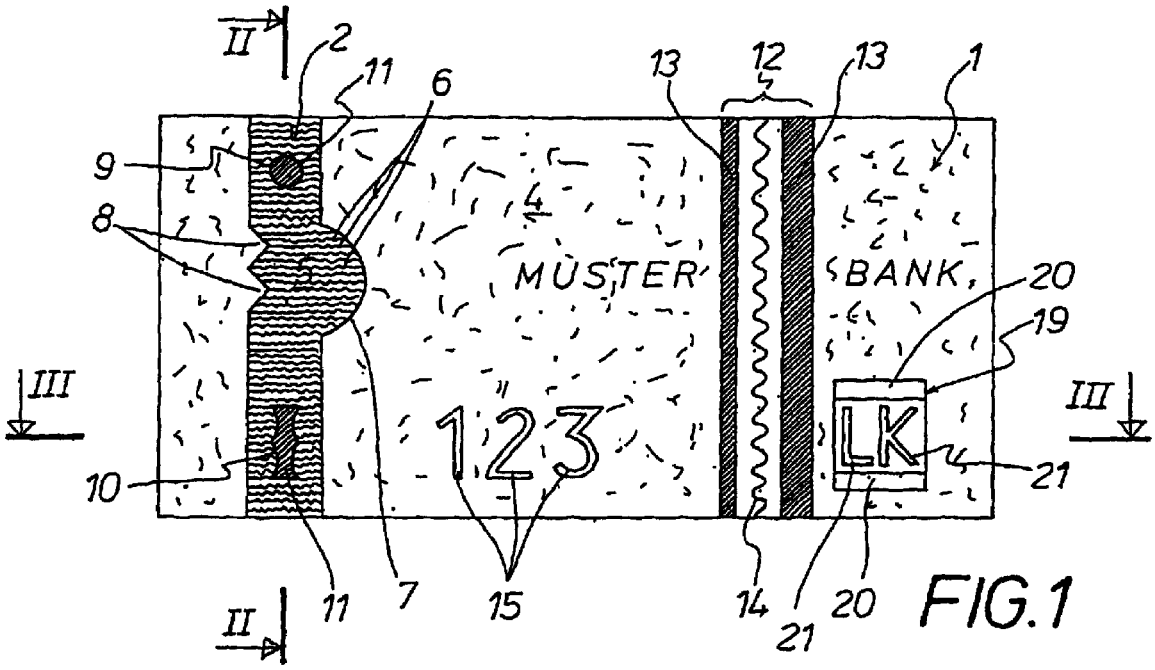
FIG. 1 is a highly diagrammatic plan view of an imaginary security document, for example a traveller's check or the like, with different security elements, wherein the substrate does not have any openings therethrough.
Figure 4:
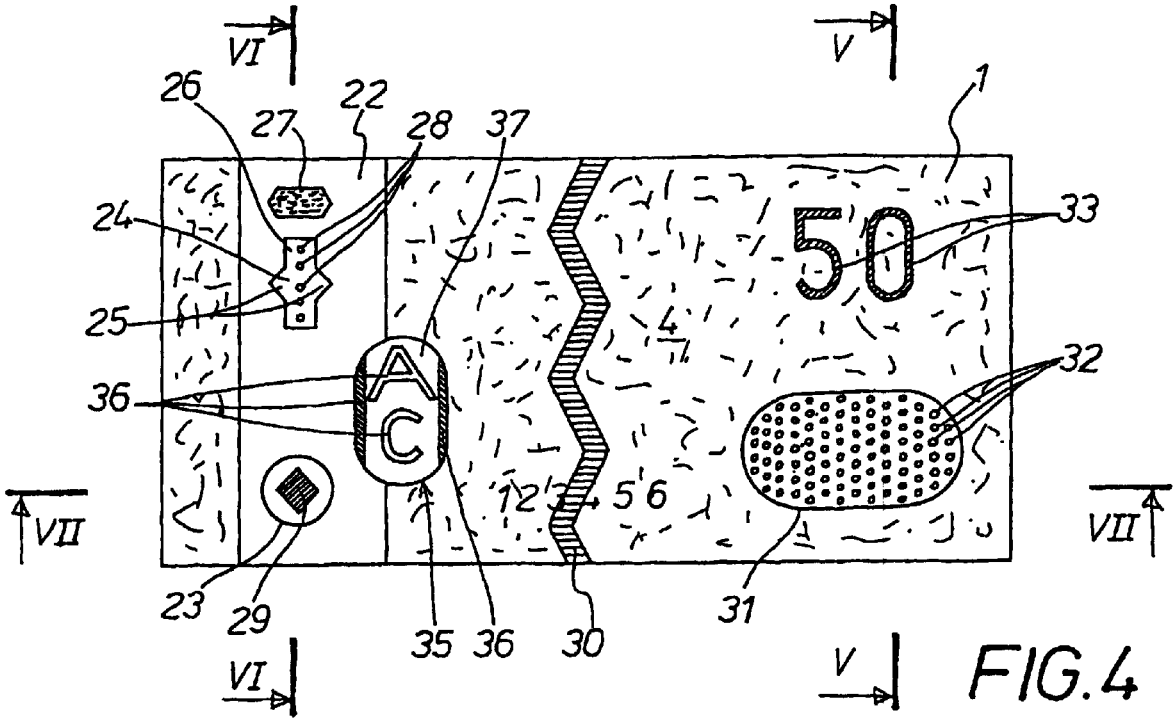
FIG. 4 is a highly diagrammatic plan view similar to FIG. 1 of another imaginary security document which also has various security elements according to the invention, including also openings.
Figure 5:
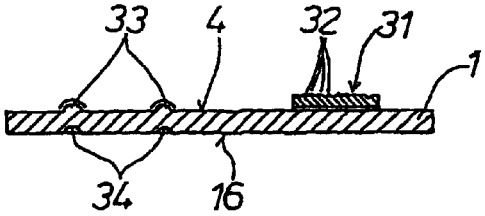
FIGS. 5 through 7 show views in section taken along line V-V, VI-VI and VII-VII in FIG. 4.

Both the security document of FIG. 1 and also the security document of FIG. 4 each comprise a substrate 1 which is formed by a possibly suitably treated paper. The difference in these two security documents essentially lies in the differing kind of security elements provided for the two security documents.

Figure 2:
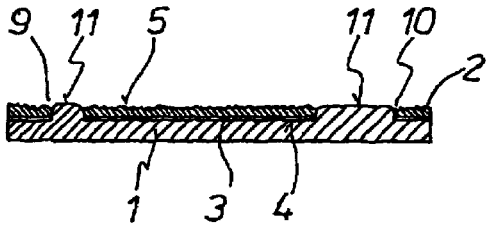
FIGS. 2 and 3 are views in section taken along lines II-II and III-III in FIG. 1.
Figure 3:
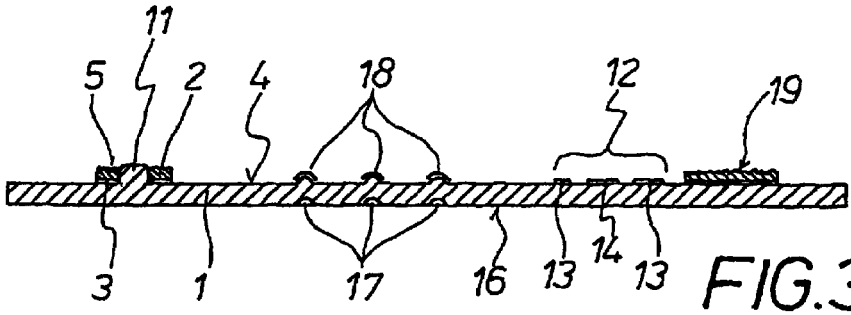

In the case of the security document shown in FIG. 1 a special surface region is formed near the left-hand edge region by a film strip 2 which, as is apparent from the views in section in FIGS. 2 and 3, is fixed by means of an adhesive 3 on the corresponding surface 4 of the substrate 1.

The film strip 3 forms a surface region of the security document, which differs in respect of its surface properties from the properties of the corresponding surface 4 of the security document. In the present case, at its surface 5 remote from the substrate, the film strip 2 is provided with an embossing or other structure 6 which produces a corresponding roughness and which for example, as indicated in FIG. 1, can be in the form of corrugation lines extending in the longitudinal direction of the security document.

A further specific form of the surface region which serves as the security element and which is formed by the film strip 2 is the particular configuration of the film strip 2 which approximately in its central region has an arcuate edge portion 7 and, in opposite relationship to that edge portion 7, an edge portion formed by two approximately triangular notches 8. It is precisely by virtue of the contrast between the triangular regions 8 and the arcuate region 7 of the edge of the film strip 2, that the specific configuration thereof can be easily felt even by a user who has comparatively little or no practice at all, if, as in the illustrated embodiment the surface 5 of the film strip 2 differs sufficiently markedly in its structure from the surface 4 of the substrate 1.

As a further security element the film strip 2 is provided with two openings 9, 10 which, as FIG. 1 clearly shows, are of differing configuration. More specifically the opening 9 is circular while the opening 10 is elongate and is provided at both sides with edges which are concavely curved in opposite relationship. When the film strip 2 is applied to the substrate 1, which can be effected for example in a rolling method, the procedure involved is desirably such that the tool used for rolling the film strip on to the substrate has a corresponding recess in the region of the openings 9 and 10, with the result that, as the sections in FIGS. 2 and 3 show, the paper serving as the substrate 1 is compressed essentially over the entire area of the film strip 2 but not in the region of the openings 9 and 10 where, as can be clearly seen in particular from FIG. 2, it extends with delimited surface regions 11 at least as far as the surface 5 of the film 2, if not even projecting somewhat therebeyond. Therefore, in the openings 9 and 10, the user can feel the surface 4 of the substrate 1, which is different from the surface 5 of the film strip 2.

If appropriate it would even be possible in this connection for the surface regions 11 of the substrate 1 to be provided with a special structure, for example fine grooving, in the openings 9, 10 of the film strip 2, during the operation of rolling or embossing the film strip 2 on to the substrate 1.

As a further security feature, the security document as shown in FIG. 1 carries a security imprint 12 thereon which extends transversely over the width of the substrate 1 and approximately parallel to the film strip 2 and which in the illustrated embodiment comprises two bars 13 of possibly different widths and a finely structured pattern 14 between the two bars 13. In this respect the imprint can be designed in such a way that it can also be felt by means of the human sense of touch, that is to say it is possible to determine by touching it whether the imprint 12 is or is not present.

A further security feature of the security document in FIG. 1 is represented by the digits 15 which are to be found approximately at the center near the lower edge and which can also be felt easily and in particular by anyone who is trained to read braille or similar characters. More specifically the digits 15 are raised with respect to the surface 4 of the substrate 1 while they are in the form of recesses 17 on the rear side 16. So that the digits 15 can also be clearly recognised when viewed normally, they are additionally correspondingly emphasised on the top side 4 of the substrate 1 with printing or a metallisation 18 thereon.

Finally, as a further security element, the security document in FIG. 1 is provided with a per se known optically variable security element 19 which for example includes a grating structure having an optical-diffraction effect, for example a hologram or the like. In that case the security element 19 can also be made in a particular configuration by suitable partial metallisation. For example, it would be conceivable to provide two metallised strips 20 in the security element 19 and also to suitably metallise the letters 21 to emphasise them. The security element 19 is desirably a security element which is known per se for such purposes and which forms part of a transfer film and which is applied to the substrate 1 for example by hot embossing, under some circumstances simultaneously with the film strip 2.

While the security document in FIG. 1 has a continuous substrate which is closed in itself, the security document in FIG. 4 is characterised in that at least some of the security elements are formed by or in conjunction with window-like openings.

Similarly to the embodiment of FIG. 1, the security document shown in FIG. 4 also has, near the left-hand edge, a strip-shaped surface region in which the surface 4 of the substrate 1 is covered by means of a film strip 22. The film strip 22 is also joined to the surface 4 of the substrate for example by means of an adhesive layer (not shown in the drawing). In contrast to the embodiment of FIG. 1 however the film strip 22 has a smooth free surface. Now, from the point of view of a user, it is possible to feel the difference between the smooth surface of the film strip 22 and the generally rougher surface 4 of the substrate 1, as a first security feature.

Figure 6:
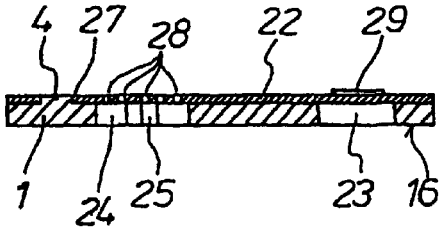
Figure 7:
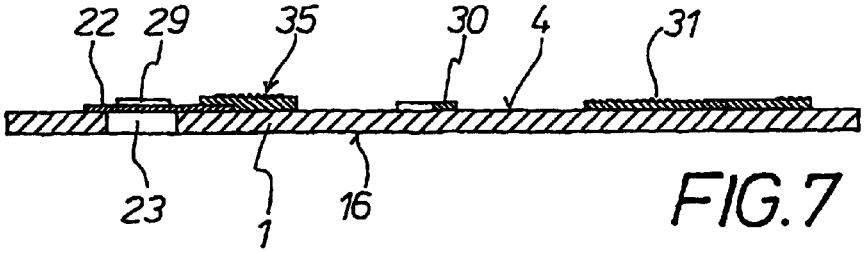

As FIGS. 6 and 7 in particular show, the film strip 22 serves to cover over two openings 23, 24 in the substrate 1.

In the illustrated embodiment the opening 23 is substantially circular and comparatively small so that it can be felt overall with one finger of a user.

The opening 24 is once again of a particular configuration—similarly to the film strip in FIG. 1—. More specifically, it is in the shape of an elongate bar provided approximately at its center on both sides with triangular projections, wherein it is precisely the triangular shape of the projections that protrude beyond the edges of the bar-like central portion 26, that can be relatively easily felt. Authentication checking is thus possible by feeling the openings 23, 24 and comparing them, in which respect the openings 23, 24 or the shape thereof can be very easily detected at the underside 16 of the substrate 1.

The film strip 22 itself is also provided with corresponding openings, more specifically on the one hand an opening 27 near the upper edge of the security document in FIG. 4, which is in the shape of an elongate hexagon. In the region of that opening 27 it is possible for the user to feel the surface 4 of the substrate 1, as can be seen from FIG. 6, so that once again a marked difference can be detected in the region of the opening 27, in the surface nature between the smooth film 22 and the surface 4 of the substrate 1.

On the other hand in the region of the opening 24, the film strip 22 is provided with perforation holes 28 which in the present case are arranged along a straight line, thereby affording a further identification option.

Finally, in the region of the opening 23, the film strip 22 is provided on its free surface with printing 29 thereon or suitable embossing. That combination of printing or embossing 29 and an opening 23—which is in opposite relationship with respect to the substrate 1—represents a means of checking authenticity.

Similarly to the printing 12 in FIG. 1, the security document in FIG. 4 is also provided with a printing 30 which extends transversely over the entire width of the substrate and which again desirably produces a structure which is different in relation to the surface 4 of the substrate. Unlike the embodiment of FIG. 1 however the printing 30 is of a comparatively simple configuration in the embodiment of FIG. 4, namely being formed by a wide line extending in an approximately zig-zag configuration.

A further security element of the security document of FIG. 4 is represented by the approximately oval surface 31 (at bottom right). The surface 31 is a surface region involving a comparatively rough structure, in which case the structure of the surface of the region 31 can be formed for example by frustoconical raised portions 32 which are provided in a film or the like which is glued on to the surface 4 of the substrate. It will be appreciated that it would also be possible for the structured surface 31 to be afforded by a layer which is suitably printed on the substrate, or the like.

Similarly to the embodiment of FIG. 1, the security document of FIG. 4 also has digits 33 of a raised configuration, which again can be overprinted or metallised for the purposes of greater ease of recognition when viewing the value-bearing paper or bond, in the region of the surface 4 of the substrate 1. The digits 33 project beyond the surface 4 of the substrate 1 while there are corresponding recesses 34 at the rear side 16 of the substrate 1.

Finally, the security document in FIG. 4 is also provided with an optically detectable and effective security element 35 which, as FIG. 4 clearly shows, overlaps with the film strip 22, that is to say it is provided in part in the region of the surface 4 of the substrate 1 and in part on the surface of the film strip 22.

The security element 35 is once again of a similar configuration to the security element 19 in FIG. 1 and has for example structured surface portions 36 and substantially smooth surface portions 37, wherein the structure of the regions 36 can represent for example a grating structure having an optical-diffraction effect, for example a hologram, or the like. In addition the security element 35 can also be partially demetallised in per se known manner to increase the level of visibility or security. The security element 35 is once again generally formed by the transferable layer or layer arrangement of a transfer film and for example, in a hot stamping operation, after application of the film strip 22, is also applied to the film strip 22 and the surface 4 of the substrate 1 in suitably overlapping positions as shown in FIG. 4.

As the foregoing description shows there are a large number of possible combinations of security elements according to the invention with each other and also with other per se known security elements. For that reason the embodiments described are also to be interpreted only as approximate examples to give an idea of what is involved. In particular the shaping of the regions involving a differing surface nature is possibly of a complicated configuration for certain situations of use or is of a configuration designed for specific areas of use.

It should further be mentioned that essentially only differing surface roughness was referred to, in respect of the various surface regions, in connection with the examples. It will be appreciated that different surface regions can also be distinguished by feeling if the mutually adjacent surface regions are of differing hardness, elasticity, slipperiness, thermal conductivity and/or stickiness, which can be achieved for example by using special plastic materials for a surface region applied to a substrate. It should also be mentioned that obviously also the substrate 1 can be formed by a suitable plastic film which is possibly provided with an appropriate coating.

It will be appreciated that, when using the idea of the invention, it is also possible for security document series to be correspondingly provided with security elements, for example series of banknotes and so forth. In that case it is either possible for all banknotes to be provided with the same security elements which can be determined by means of the human sense of touch. Another possible way which is in fact rather employed in practice would be that of providing security elements which admittedly basically have the same action for all banknotes, but making the size and shape of the elements which can be felt different, in the different security documents. For example, the width of the film strip 2 in FIG.

1 could be different, in dependence on the value of a corresponding banknote. Another possibility would be for the special edge regions 7, 8 to be provided at different positions or for the edge regions of the film strip 2 to be of different configurations, either by virtue of a differing curvature for the edge region 7 or by virtue of a variation in the number and shape of the triangular recesses 8.

Finally, as an essential advantage of the security documents according to the invention, it should be pointed out that in those documents it is possible to forego special elements which can be felt by blind persons or visually impaired persons as in fact that circle of people can also determine and identify the security elements proposed according to the invention, without problems. In addition, in relation to blind persons, there is a substantially better level of security in respect of the security documents, in comparison with security documents with usual braille characters, as such characters can nonetheless in fact be comparatively easily imitated, they involve a certain degree of standardisation and they suffer badly in use of the documents.

The invention claimed is:

1. A security document, in particular a value-bearing paper, comprising at least one security element provided on a surface of the substrate forming the security document, wherein to form the security element at least one surface region of the security document is of a configuration and size specific to the respective security document in such a way and is spatially displaced, for example recessed or raised, at least relative to the surface of the substrate which is adjacent or surrounding the surface region, and/or is of such a different roughness, hardness, elasticity, slipperiness, thermal conductivity and/or stickiness, that the configuration and size of the surface region can be established as a consequence of the differing surface nature thereof by means of the human sense of touch, and wherein the at least one surface region is formed by a film portion which is of a corresponding configuration and which is applied to the substrate and which comprises a material different from the substrate and which has openings through which the surface of the substrate can be felt.

2. A security document as set forth in claim 1, wherein the substrate and the film portion are formed by different kinds of film, which markedly differ in properties which can be detected by means of the human sense of touch.

3. A security document as set forth in claim 1, wherein the substrate and the film portion are formed by papers with respective markedly different surface properties which can be determined by means of the human sense of touch.

4. A security document as set forth in claim 3, wherein the different surface properties of the papers are formed by corresponding printing.

5. A security document as set forth in claim 3, wherein the different surface properties of the papers are produced by region-wise mechanical processing of the papers, in particular by roughening, embossing and/or glazing.

6. A security document as set forth in claim 1, wherein the security document has a plurality of surface regions which have different surface properties in relation to the substrate surface.

7. A security document as set forth in claim 6, wherein the surface regions involve a differing configuration, size and/or surface nature.

8. A security document as set forth in claim 1, wherein the film is three-dimensionally embossed at least in region-wise manner for producing a particular structure.

9. A security document as set forth in claim 1, wherein the film is provided in region-wise manner with a coating, for example printing thereon, which produces a special surface nature which can be felt.

10. A security document as set forth in claim 1, wherein the edge of the at least one surface region is in the configuration of a simple geometrical figure.

11. A security document as set forth in claim 10, wherein the at least one surface region is in the form of an elongate rectangle, in particular of a strip shape.

12. A security document as set forth in claim 1, wherein at least in the at least one surface region the substrate is deformed by embossing to provide forwardly curved portions on a surface of the substrate and corresponding recesses on the other surface of the substrate.

13. A security document as set forth in claim 1, wherein the substrate has at least one surface region of a surface nature which differs in relation to the surrounding surface of the substrate, and at least one opening.

14. A security document as set forth in claim 1, wherein it is provided with at least one further security element which can be checked optically or by machine.

15. A security document as set forth in claim 14, wherein the security element which can be checked optically or by machine overlaps at least region-wise with the at least one surface region of the surface nature which differs in relation to the surrounding surface of the substrate and/or the opening.

16. A security document as set forth in claim 14, wherein the security element which can be optically checked is formed by a pattern comprising diffraction structures, for example a hologram, and/or a region-wise metallization.

17. A security document, in particular a value-bearing paper, comprising at least one window-like opening in the substrate of the security document, said opening forming at least part of a security element, wherein the window-like opening is of a configuration and size specific to the respective security document and is so adapted that the configuration and size of the opening can be determined by means of the human sense of touch, and wherein the opening is covered by a film fixed on a surface of the substrate, wherein the film has a surface nature which is markedly different from the surface nature of the substrate in a manner which can be determined by means of the human sense of touch, insofar as it is provided that a) the film projects beyond the opening of the substrate and in its projecting region is provided with at least one aperture through which the surface of the substrate can be felt, and/or b) the film is three-dimensionally embossed at least region-wise to produce a particular structure, and/or c) the film is provided at least in its region covering the opening with a perforation in the form of a pattern which can be easily felt.

18. A security document as set forth in claim 17, wherein the security document has a plurality of window-like openings which can be felt in respect of size and configuration by means of the human sense of touch.

19. A security document as set forth in claim 18, wherein the openings are of differing configuration and/or size and/or are covered with a film having different properties.

* * * * *

UNITED STATES PATENT AND TRADEMARK OFFICE

CERTIFICATE OF CORRECTION

PATENT NO. : 7,654,578 B2
APPLICATION NO. : 10/541935
DATED : February 2, 2010
INVENTOR(S) : Werner Reinhart It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 935 days.

Signed and Sealed this

Twenty-eighth Day of December, 2010

David J. Kappos

David J. Kappos
*Director of the United States Patent and Trademark Office*